US009784415B2

(12) United States Patent
Linge

(10) Patent No.: US 9,784,415 B2
(45) Date of Patent: Oct. 10, 2017

(54) SAFETY ILLUMINATION SOLUTIONS FOR HANDRAILS, GRAB BARS, FLOOR MATS AND THE LIKE

(71) Applicants: Jennifer Sande, Winnipeg (CA); Julie Linge, Winnipeg (CA)

(72) Inventor: Julie Linge, Winnipeg (CA)

(73) Assignee: Jennifer Sande, Winnipeg, Manitoba (CA)

( * ) Notice: Subject to any disclaimer, the term of this patent is extended or adjusted under 35 U.S.C. 154(b) by 0 days.

(21) Appl. No.: 14/804,862

(22) Filed: Jul. 21, 2015

(65) Prior Publication Data

US 2016/0025271 A1 Jan. 28, 2016

Related U.S. Application Data

(60) Provisional application No. 62/027,455, filed on Jul. 22, 2014.

(51) Int. Cl.

| | |
|---|---|
| ***F21K 2/00*** | (2006.01) |
| ***A47K 17/02*** | (2006.01) |
| ***A47K 3/00*** | (2006.01) |
| ***A47K 17/00*** | (2006.01) |
| *E04F 11/18* | (2006.01) |
| *A47G 27/02* | (2006.01) |

(52) U.S. Cl.

CPC ..... *F21K 2/00* (2013.01); *A47K 3/003* (2013.01); *A47K 17/00* (2013.01); *A47K 17/022* (2013.01); *A47K 17/026* (2013.01); *A47G 27/0225* (2013.01); *E04F 11/1802* (2013.01); *E04F 2011/1872* (2013.01)

(58) Field of Classification Search

CPC ..... F21V 33/004; A47K 3/003; A47K 17/00; A47K 17/022; A47K 17/026; A47G 27/00–27/065; F21K 2/00

See application file for complete search history.

(56) References Cited

U.S. PATENT DOCUMENTS 1,969,958 A * 8/1934 Alder ..... A47K 3/003 16/DIG. 2
4,890,355 A * 1/1990 Schulten ..... A45F 5/1046 16/421

(Continued)

*Primary Examiner* — Anh Mai
*Assistant Examiner* — Nathaniel Lee
(74) *Attorney, Agent, or Firm* — Kyle R. Satterthwaite; Ryan W. Dupuis; Ade & Company Inc.

(57) ABSTRACT

A safety cover for use on a handrail, grab bar or peripheral edge of a fixture or object at a darkened location. The cover features a longitudinally split tubular member of resiliently flexible material and an illumination source carried thereby that is operable to provide illumination of the darkened location. The tubular member has a circumferential resiliency that biases two free edges of the tubular member toward one another from to automatically close up the longitudinal split, whereby the tubular member frictionally grips the rail, bar or peripheral edge over which it is placed. An illuminating floor mat or toilet lid cover features at least one longitudinally-shaped illumination member running along at least one peripheral edge of the mat or cover with one or more light-emitting areas of said longitudinally-shaped illumination member in a visually detectable position left unconcealed by the mat or cover.

3 Claims, 3 Drawing Sheets

(56) References Cited

U.S. PATENT DOCUMENTS

| | | | | |
|---|---|---|---|---|
| 5,637,378 | A * | 6/1997 | Hensler | A47G 27/0212 428/192 |
| 7,771,070 | B2 * | 8/2010 | Tarlton | G02B 6/0003 362/34 |
| 7,934,701 | B2 * | 5/2011 | Kay | B21C 23/142 256/1 |
| 2014/0134358 | A1 | 5/2014 | Hart | |

* cited by examiner

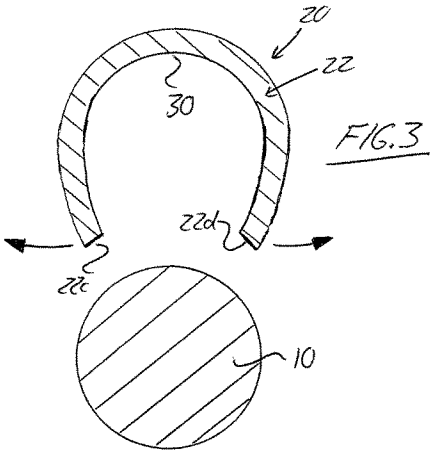
FIG. 3
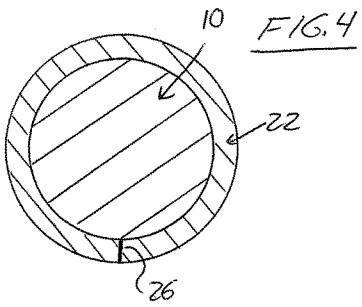
FIG. 4
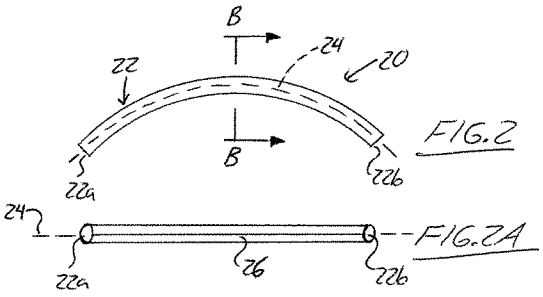
FIG. 2
FIG. 2A
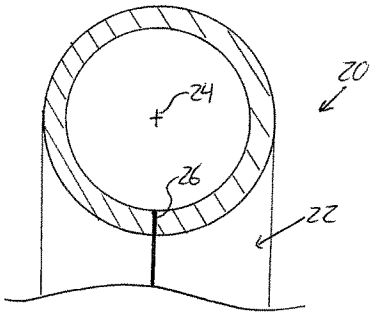
FIG. 2B

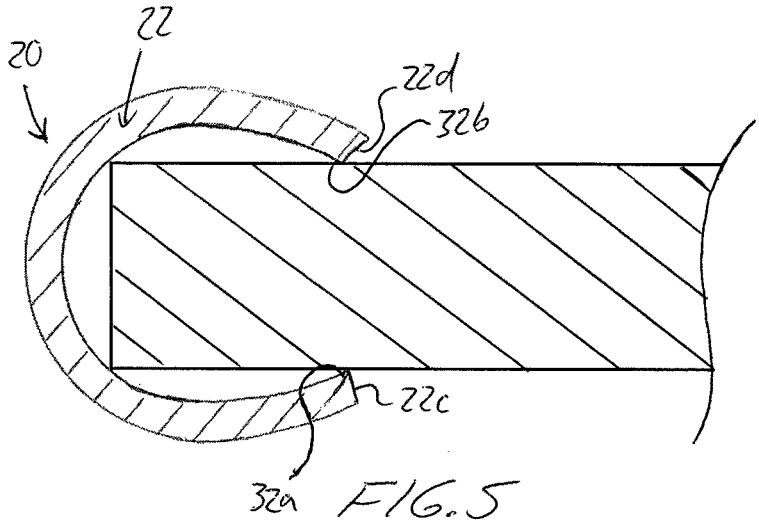
FIG. 5
FIG. 6
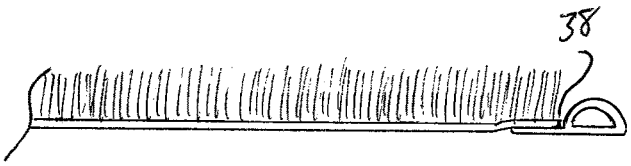
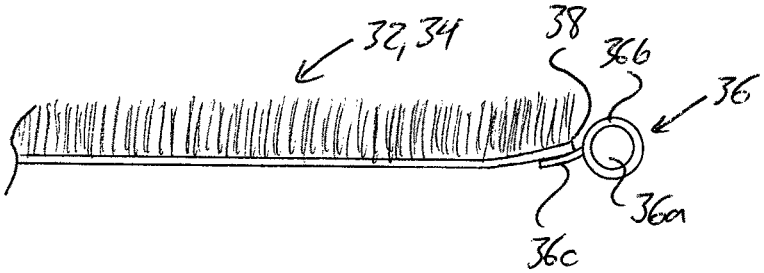
FIG. 6A

SAFETY ILLUMINATION SOLUTIONS FOR HANDRAILS, GRAB BARS, FLOOR MATS AND THE LIKE

CROSS REFERENCE TO RELATED APPLICATIONS

This application claims benefit under 35 U.S.C. 119(e) of Provisional Application Ser. No. 62/027,455, filed Jul. 22, 2014.

FIELD OF THE INVENTION

The present invention relates generally to sources of illumination for residential and institutional bathrooms or other areas where grab bars, handrails and floor mats may be employed, whereby illumination of such equipment, fixtures or objects can provide a safe environment for users without needing to turn on primary electrical lighting fixtures during night-time use of such facilities. Other applications include the use of disclosed illumination solutions on bed rails, or on mobility equipment such as walkers, canes, wheelchairs, etc.

BACKGROUND

Grab bars are commonly employed in bathrooms for added safety to those that may require auxiliary support when accessing and departing bathroom fixtures such as bathtubs, showers and toilets.

It has been previously recognized that such grab bars can become slippery when exposed to moisture, potentially leading to injury should one's hand inadvertently slip free of the grab bar during use.

On prior art solution to this issue is a product being marketed as the Med-Grip grab bar accessory (http://www.secure-grip.com), which is a non-slip cover that is secured in place around a bathroom grab-bar by way of a zipper in order to provide an improved gripping surface. A similar product referred to as the Secure-Grip is available for other handrail applications. However, the product provides no illumination functionality for improved night-time visibility.

U.S. Pat. No. 7,934,701 discloses handrail safety devices in which luminescent material is provided within a longitudinal channel on the exterior of either a tubular handrail member, or a semi-circular cap that is placed over an existing handrail. The reference describes the semi-circular cap is being securable to the handrail by screws, adhesive, clamps, or interference fit. Accordingly, the device requires use of separate fastening elements to secure it in place, or a customized interference fit according to the specific handrail on which it is to be used.

Accordingly, there is a desire for a more flexible solution that is easier to install without requiring separate fasteners or specialized manufacturing dependent on the particular installation being contemplated.

U.S. Patent Application Publication 2014/0134358 discloses a safety grip with a luminescent, textured exterior surface to improve handrail safety. However, the finished grip is created by end-to-end mating of a plurality of cylindrical grips slid into the place over the hand rail. Accordingly, installation requires access to a free end of the handrail by which the grips can be slid onto the handrail. Accordingly, installation on a previously installed handrail or grab bar would require disassembly of same.

Applicant has invented a new illuminating cover solution for grab-bars and handrails that provides easy tool-free installation, and that is also applicable to other fixtures or objects to similarly provide added safety thereto. A safety illumination solution for floor mats and toilet lid covers is also disclosed, which also improve on bathroom safety during night time use.

SUMMARY OF THE INVENTION

According to one aspect of the invention there is provided a safety cover for fitting over a bar or rail shaped piece of safety equipment, such as a handrail or grab bar, or for fitting over a peripheral edge of another type of fixture or object, the safety cover comprising:

a split tubular member of resiliently flexible material having a longitudinal axis that defines a lengthwise dimension measured between opposing ends of said split tubular member, a circumferential span in cross-sectional planes lying normal to said longitudinal axis that continuously spans a substantial majority of a circumference around said longitudinal axis, and a longitudinal split that extends an entirety of the lengthwise dimension from one of said opposing ends of the split tubular material to the other and forms an only break in the otherwise continuous circumferential span of the tubular member around the longitudinal axis; and an illumination source carried by the split tubular member and operable to emit light therefrom to provide at least partial illumination of a darkened location at which the safety equipment, fixture or object resides;

wherein the circumferential span of the split tubular member has a circumferential resiliency that biases two free edges of the circumferential span toward one another from opposing sides of the break in the otherwise continuous circumferential span and thereby acts to automatically close up or reduce a width of the longitudinal split measured between said two free edges.

Preferably the illumination source is a photo-luminescent material.

Preferably the photo-luminescent material is embodied within the split tubular member.

Preferably the split tubular member has a longitudinal resiliency acting to bias the split longitudinal member into an arc-shaped configuration between the opposing ends thereof.

Preferably the split tubular member has a uniform wall thickness and uniform material composition throughout the circumferential span of the split tubular member.

According to a second aspect of the invention, there is provided a method of installing a safety cover of the type recited in the first aspect of the invention, by prying apart the free edges of the circumferential span of the split tubular member and thereby enlarging the width of the longitudinal split to an amount exceeding a width of either the bar or rail shaped piece of safety equipment or the peripheral edge of the fixture or object, and slipping the enlarged longitudinal split over the piece of safety equipment or over the peripheral edge of the fixture or object.

The method may include slipping the enlarged longitudinal split over the bar or rail shaped piece of safety equipment so as to receive the bar or rail shaped piece of safety equipment fully inside the split tubular member, and releasing the free edges of the circumferential span and allowing the free edges to resiliently abut into contact with one another in order to fully close the split tubular member around the bar or rail shaped piece of safety equipment, thereby retaining the safety cover in place thereon.

Alternatively, when the width of the piece of safety equipment or the width of the peripheral edge of the fixture or object exceeds a diameter of the split tubular member, the method may include releasing the free edges of the circumferential span and allowing the circumferential resiliency of the split tubular member to frictionally engage an interior surface of the split tubular member against the piece of safety equipment, fixture or object, thereby retaining the safety cover in place thereon.

According to a third aspect of the invention, there is provided an illuminating floor mat or toilet lid cover comprising:

a floor mat or toilet lid cover having an outer perimeter delimiting a shape of the floor mat or toilet lid cover; and at least one longitudinally-shaped illumination member running longitudinally along at least one peripheral edge of the mat or cover with one or more light-emitting areas of said longitudinally-shaped illumination member in a visually detectable position left unconcealed by the mat or cover.

Preferably the longitudinally-shaped illumination member is a photo-luminescent member running longitudinally along the peripheral edge of the mat in the unconcealed visually detectable position.

Preferably the longitudinally-shaped illumination member has an attachment flange that extends laterally therefrom into a position lying over or under the mat or cover, and the longitudinally-shaped illumination member is affixed to the mat by way of said attachment flange.

Preferably the attachment flange is sewn to the mat.

The longitudinally-shaped illumination member may comprise a photo-luminescent core, and a sheath that closes around the core and to which the attachment flange is coupled.

According to another aspect of the invention, there is provided a safety cover for fitting over a bar or rail shaped piece of safety equipment, such as a handrail or grab bar, or for fitting over a peripheral edge of another type of fixture or object, the safety cover comprising:

a split tubular member of resiliently flexible material having a longitudinal axis that defines a lengthwise dimension measured between opposing ends of said split tubular member and a circumferential span in cross-sectional planes lying normal to said longitudinal axis that continuously spans a substantial majority of a circumference around said longitudinal axis, said split tubular member being split longitudinally over an entirety of the lengthwise dimension from one of said opposing ends of the split tubular material to the other;

wherein the split tubular member comprises a uniform material composition fully throughout an entirety of the split tubular member, and said uniform material composition comprises a transparent or translucent, and resiliently flexible, material, within which photo-luminescent material is incorporated and dispersed, whereby the transparent or translucent material admits external light to said photo-luminescent material for charging thereof in illuminated environments and transmits irradiated light from said photo-luminescent material to illuminate the safety cover in darkened environments; and wherein the circumferential span of the split tubular member has a circumferential resiliency that biases said split tubular member toward a fully closed state around said longitudinal axis to perform a self-gripping action on the safety equipment, fixture or object when said split tubular member is pried open and fitted over a bar-shaped, rail-shaped, or edge feature of said safety equipment, fixture or object.

BRIEF DESCRIPTION OF THE DRAWINGS

One embodiment of the invention will now be described in conjunction with the accompanying drawings in which:

FIG. 2 is a side elevational view of an illuminating safety cover according to one embodiment of the present invention, which takes the form of an arc-shaped, longitudinally split tubular member with photo-luminescent material incorporated within the wall of the split tubular member.

FIG. 2A is a bottom plan view of the safety cover of FIG. 2, showing the longitudinal split therein.

FIG. 2B is a cross-sectional view of the safety cover of FIG. 2 as taken along line B-B thereof.

FIG. 3 is a schematic cross-sectional view illustrating installation of the safety cover of FIG. 2 on a circular grab-bar by prying apart two free edges of the split tubular member to enlarge the longitudinal split to a width sufficient to fit over the grab bar.

FIG. 4 shows the safety cover and grab bar of FIG. 3 safety cover fully installed so as to close around the grab bar with the inner surface of the safety cover frictionally engaged against the circumference of the grab bar.

FIG. 5 schematically illustrates the safety cover of FIG. 2 installed on a peripheral edge of a bathroom vanity countertop, thereby demonstrating the cover's self-gripping installation on equipment, fixtures or objects of various sizes and shapes.

FIG. 6 is a cross-sectional view illustrating one embodiment of an illuminating floor mat of the present invention, which features a flange-equipped photo luminescent member running along a perimeter edge of the mat.

FIG. 6A is a cross-sectional view similar to that of FIG. 6, showing an alternate cross-sectional shape of the photo-luminescent member.

In the drawings like characters of reference indicate corresponding parts in the different figures.

DETAILED DESCRIPTION

Figure 1:
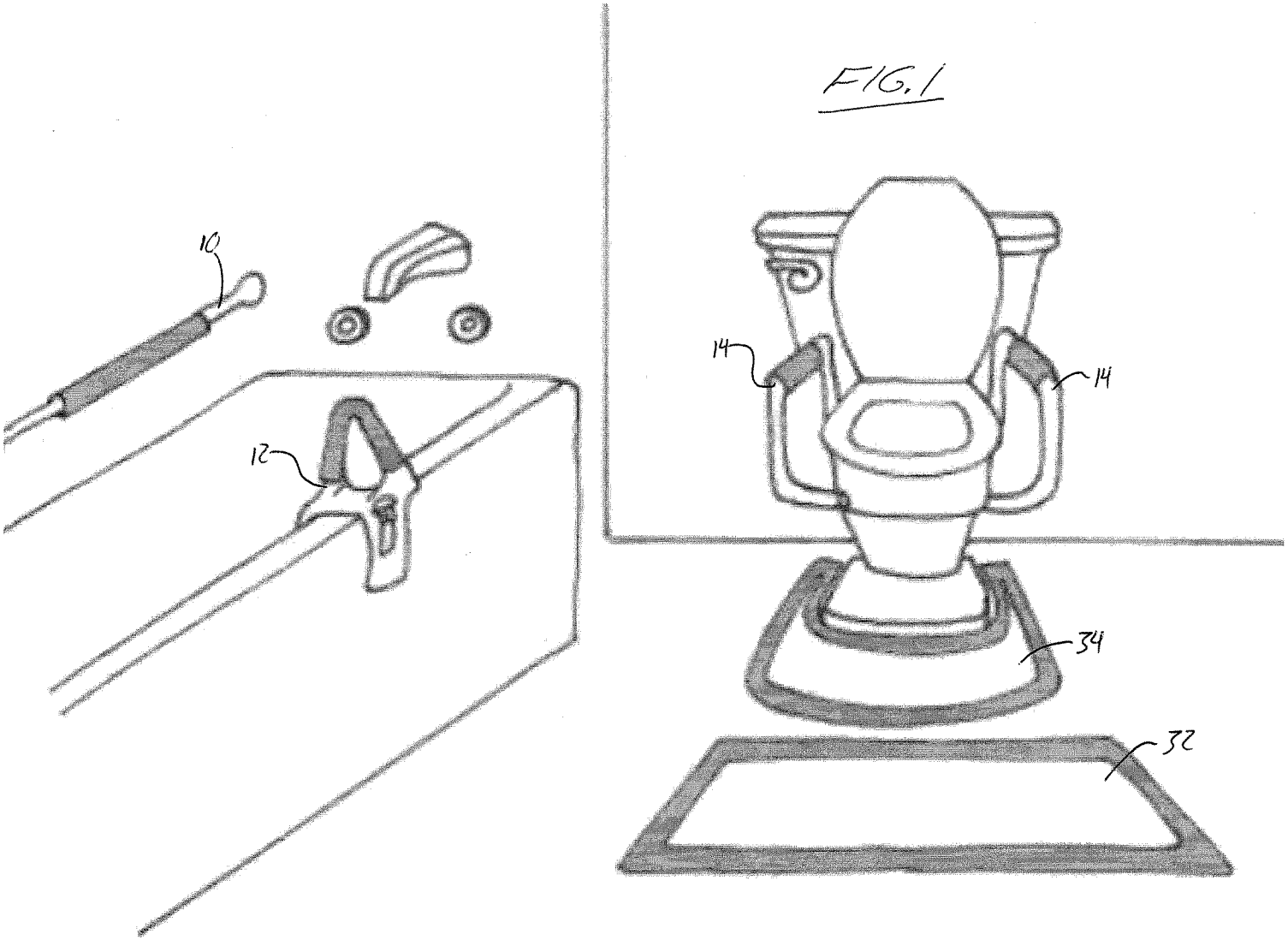
FIG. 1 is a perspective view illustrating a residential or institutional bathroom in which illuminating accessories of the present invention have been installed on a shower handrail, bathtub grab bar, toilet armrests, and bath and toilet floor mats.

FIG. 1 illustrates use of photo-luminescent safety covers of the present invention on a wall-mounted tub/shower rail 10, a tub-mounted grab bar 12, and a pair of raised toilet seat arm-rests 14. This way, a visitor to the bathroom facility at night is provided with a source of illumination without having to turn on a wall or ceiling mounted light, or other electrically operated light fixture. By providing photo-luminescent material at the location of grab bars, hand rails or arm rests, improved safety is also provided by visually highlighting these pieces of safety equipment to those who require the assistance of such equipment.

Turning to FIG. 2, a suitable cover 20 for use on grab bars and hand rails and illustrated. The cover 20 is the form of a longitudinally split length of tubing 22 to which photo-luminescent material has been applied, or within which photo-luminescent material has been incorporated during manufacturer. The primary material of the tubing, to which the photo-luminescent material is added, is a resiliently flexible material, for example rubber, acrylic, or silicone. The natural default shape of the tubing is arcuate along its length. A central longitudinal axis 24 around which the wall of the tubing extends is thus curved in its travel from one end 22*a* of the tubing to the other opposing end 22*b*. A longitudinal split 26 is provided in the tubing and runs fully from one end 22*a* to the other 22*b*, and forms the only break or discontinuity in the otherwise continuous circumferential span of the tubing around its central longitudinal axis A.

Both the radius and diameter of the hollow interior of the tubing are greater than the wall thickness of the tubing in the illustrated embodiment to make the tubing easily flexible to a user, and the wall thickness is uniform throughout to give similar pliability throughout the cross-section.

The tubing has resilient character in both its circumference and length, whereby the longitudinal resiliency will bias the length of the tubing into an arcuate shape like that of FIG. 2, and the circumferential resiliency will bias the cross-sectional wall shape of the tubing (as seen in planes lying normal to the longitudinal axis 24, such as the viewing plane of FIG. 2A) into a closed condition spanning fully around the axis 24. As shown in FIG. 3, the two free edges 22*c*, 22*d* of the tubing wall's substantially full circumferential span about the axis 24 can be pried apart by pulling them away from one another against the resilient force that normally abuts them together into closed contact. Applicant has found that commercially available silicone tubing, when longitudinally cut to form the described longitudinal split, provides these resilient characteristics, and so specialized tubing manufacture techniques are not necessarily required, and therefore are not described herein. Likewise, flexible plastic tubing of other non-foam plastic compositions are expected to be able to provide equivalent functionality. Liquid impermeable materials may be preferable to avoid penetration by water or soap in bath/shower applications to avoid trapping of same between the cover the underlying equipment, and prevent interference with frictional contact between the cover and the underlying equipment.

FIG. 3 illustrates installation of the cover 20 on a straight grab bar or hand rail of circular cross-section, for example like the wall-mounted tub/shower rail 10 of FIG. 1. The two free edges 22*c*, 22*d* of the tubing wall are manually pulled apart using digits of the installer's opposing hands, as schematically shown by arrows 28 that represent a prying force that is sufficient to overcome the circumferential resiliency force of the split tubing. The free edges 22, 22*d* are pulled far enough apart from one another so that the width of the longitudinal slot 26 measured between them increases to an amount greater than the diameter of the hand rail 10. At this point, the pried-open longitudinal slot is lowered down over the top of the hand rail 10, thereby inserting the topside of the hand rail 10 into the interior space of the split tubing. The cover is forced downwardly until the free edges 22*c*, 22*d* have reached downwardly past the horizontal diameter of the hand rail 10, and the area 30 of the tube's interior surface lying opposite to the longitudinal slit 26 rests atop the hand rail 10. At this point, release of the pried-apart free edges 22*c*, 22*d* allows them to resiliently move back toward another at the underside of the rail 10. Provided that the hand rail diameter 10 doesn't exceed the default diameter of the tubing's closed condition, the free edges 22*c*, 22*d* will return into contact with one another, thereby completing a full-circumference enclosure of the split tubing around the entirely of the hand rail.

While the forgoing process describes forcing the cover downwardly onto the hand rail from the topside thereof, the same installation process can be performed in other directions, for example forcing it upwardly onto the hand rail from below, or laterally onto the hand rail from the side thereof. The flexibility of the tubing allows the normally arcuate tubing to conform to the linear shape of the hand rail or grab bar by repetition of this prey-push-release action at sequential points moving along the length of the tubing. The normal curvature of the tubing also allows better kink-free conformation of the tubing with equipment of non-linear shape, such as the generally inverted U-shape or inverted V-shape of the illustrated tub-mounted grab bar 12. Even if the diameter of the hand rail 10 is greater than the normal diameter of the split-tubing, the cover 22 will still provide a self-gripping action on the hand rail 10, so long as the tubing is large enough so that the longitudinal slot can be enlarged to a width exceeding the hand rail diameter so that the two free edges can still effectively hook partially around the hand rail without closing entirely therearound.

Installation of the tubing on a shower/tub hand rail, grab bar, toilet seat arm rest, bedrail, etc. provides a more resilient surface for the user to grasp, thereby improving the grip of the rail, bar, or armrest. If the primary material of the tubing is transparent or translucent, then dispersing of a photo-luminescent material into the primary material during manufacture of the tubing will cause the tubing to emit light in a darkened bathroom or other unlit environment once the photo-luminescent material has been suitably charged by another light source (e.g. sunlight exposure through a window during the daylight, ambient light through an open doorway, charging with a bathroom light fixture before the user goes to sleep, etc.). Other means of carrying photo-luminescent material on the tube may be employed, for example by attachment of a sheet-style photo-luminescent product to the exterior surface of the tubing. Applicant found that a commercially available glow in the dark vinyl sheet called LunaGel Glow Sheet by Lunabrite Light Technology of Mountain Lakes, N.J. (http://www.lunabrite.com) was easily attached to split tubing by way of heat transfer, and provided suitable results. Alternatively, photo-luminescent material may be provided on the split tubing by other means. Illumination sources other than photo-luminescent material may alternatively be employed to provide the split tubing with its illumination functionality, but photo-luminescent material may be advantageous in order to avoid the need for battery-powered or mains-powered electrical lighting components.

FIG. 5 illustrates how the split tubing may also be installed over a peripheral edge of an object or fixture other than a hand rail or grab bar. The drawing shows the cover 20 installed on a peripheral edge of a countertop, for example of a bathroom vanity. The installation process is similar to that described above for a hand rail. The free edges of the cover are pried apart by a distance exceeding the width of the countertop edge (i.e. the 'thickness' or 'height' dimension of the countertop at its exposed peripheral edge), and then the closed-end of the tubing's split cross-section lying opposite to the longitudinal split 26 is pushed toward the countertop edge with the two free edges 26*c*, 26*d* residing above and below the countertop. The cover 20 is automatically retained in place on the countertop edge by a self-gripping action achieved by the circumferentially resilient action that forces the free edges 22*c*, 22*d* toward one another, as this forces the interior surface of the tubing (i.e. at the corners 32*a*, 32*b* where the inside surface of the tubing meets the free edges 22*c*, 22*d*) into frictional contact against the topside and underside of the countertop. Such an installation of a photo-illuminescent cover on a countertop edge, table edge, or other furniture edge can be used to provide night-time illumination of bathrooms or other areas without requiring activation of an electrical light source.

A self-gripping split-tube illumination device like that described above may be slipped on and frictionally engaged to a bath-side floor mat 32 or toilet-embracing floor mat 34, like those shown in FIG. 1. However, FIG. 6 illustrates another possible solution for an illuminating floor mat that may similarly be used to improve night-time visibility in a bathroom or other area while avoiding activation of a ceiling or wall mounted light or other electrical lamp.

FIG. 6A illustrates a floor mat showing use of a tubular, elongated photo-luminescent body 36 of the type shown in FIG. 1B of U.S. Pat. No. 7,771,070 of Lunabrite Inc., hereafter referred to as the Lunabrite Patent, and the entirety of which is incorporated herein. Although FIG. 6A illustrates only one perimeter edge of a floor mat, it will be appreciated that such a longitudinal photo-luminescent element may be provided at each and every perimeter edge of a floor mat, as illustrated schematically in FIG. 1. The photo-luminescent body 36 features a photo-luminescent core 36*a* surrounded by a sheath 36*b*, and having a selvedge or flange 36*c* coupled to the sheath and extending laterally therefrom to a position reaching inwardly from the perimeter edge 38 of the mat at the underside thereof. The flange 36*c* is sewn, adhered, fused or otherwise affixed to the mat from the underside thereof in order to attach the photo-luminescent body 36 to the mat in a position residing outwardly beyond the perimeter edge thereof so as not to be visually concealed beneath the mat. FIG. 6 illustrates a similar configuration, but uses a photo-luminescent body 36' of different cross-sectional shape, particularly replacing the circular sheath of FIG. 6A with a semi-circular sheath positioned flat-side down so as to provide a lower-profile lighting solution at the edge of the mat.

The floor mat may use a photo-luminescent member other than the particular construction described in the incorporated Lunabrite Patent. For example, a coupling flange on an elongated illumination member may be used to sew, adhere or otherwise affix it to the mat, regardless of whether the illumination member uses the particular core and sheath configurations described and illustrated in the incorporated Lunabrite Patent. For example, glow-in-the-dark rope or tubing is commercially available from a number of existing suppliers, and could be modified to include a suitable attachment flange. An illumination member may similarly be sewn or otherwise attached to an exterior of a toilet lid cover at the perimeter thereof, where it externally wraps under the perimeter edge of the toilet seat and connects to the underlying elasticized rim at the open bottom of the toilet seat cover.

The disclosed embodiments of the invention include a non-slip, safety cover formed of soft rubber, acrylic, silicone, or any other resiliently flexible material that can incorporate photo luminescent materials dispersed within and incorporated into the material in a manner providing visually detectable illumination when charged. The disclosed covers are suitable for attachment to all manner of existing bathroom safety items including shower handrails, bathroom grab bars, tub rails and toilet armrests, as well as medical institution grab bars, handrails, and beds. As well, the glow-in-the-dark safety covers would be applicable for assisted mobility devices such as canes, walkers, rollators, and wheelchairs. The covers are slit down the middle to allow their placement over bathroom safety items and assistive mobility devices. In some embodiments, the covers may be capable of recharging in 5-30 minutes from ambient light, sunlight, or powered light bulb, and provide subsequent glowing action for 8 or more hours until recharged. These performance specifications are provided as examples only, and are not intended to limit the scope of the present invention.

As mentioned above, conventional grab bars can be slippery when wet, potentially leading to injuries. The covers disclosed herein help prevent accidents from hands slipping off of the grab bar and can be placed over existing grab bars/handrails. The glow-in-the-dark component can provide lighting sufficient to see objects in the bathroom without the need to turn on a light and incur visual problems (e.g., bright light splits rhodopsin, making it difficult for eyes to detect light properly), including lowering the chemicals serotonin and melatonin, and disrupting the circadian rhythm. The covers make it easier to locate/pinpoint the toilet, grab bars, edge of the bathtub, etc., when walking to the bathroom at night, and may be especially helpful for people with poor vision who can't quite make out the shape of the toilet in the dark. The covers also offer a practical solution for those who don't want to turn on the light and awaken their spouse. Another potential target market is for consumers who don't want to "waste electricity" by turning on the light, whether for financial or environmental reasons.

Older hands can attach the covers without difficulty, by just slipping the flexible, waterproof covers over any suitable bathroom safety product or other object. The glow-in-the-dark material will absorb indoor light during the day, and provide an intense locator glow, for example in green or other colors, all night long. The glow-in-the-dark items disclosed herein may also contain antimicrobial agents to prevent the growth of bacteria.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A safety cover for fitting over a bar or rail shaped piece of safety equipment, such as a handrail or grab bar, or for fitting over a peripheral edge of another type of fixture or object, the safety cover comprising:

a split tubular member of resiliently flexible material having a longitudinal axis that defines a lengthwise dimension measured between opposing ends of said split tubular member and a circumferential span in cross-sectional planes lying normal to said longitudinal axis that continuously spans a substantial majority of a circumference around said longitudinal axis, said split tubular member being split longitudinally over an entirety of the lengthwise dimension from one of said opposing ends of the split tubular material to the other;

wherein the split tubular member comprises a uniform material composition fully throughout an entirety of the split tubular member, and said uniform material composition comprises a transparent or translucent, and resiliently flexible, material, within which photo-luminescent material is incorporated and dispersed, whereby the transparent or translucent material admits external light to said photo-luminescent material for charging thereof in illuminated environments and transmits irradiated light from said photo-luminescent material to illuminate the safety cover in darkened environments; and wherein the circumferential span of the split tubular member has a circumferential resiliency that biases said split tubular member toward a fully closed state around said longitudinal axis to perform a self-gripping action on the safety equipment, fixture or object when said split tubular member is pried open and fitted over a bar-shaped, rail-shaped, or edge feature of said safety equipment, fixture or object.

2. The safety cover of claim 1 wherein the split tubular member has a longitudinal resiliency acting to bias the split tubular member into an arc-shaped configuration between the opposing ends thereof.

3. The apparatus of claim 1 in combination with the equipment, fixture or object, wherein a default diameter of the split tubular member normally occupied thereby due to the circumferential resiliency is lesser than a width of the equipment, fixture or object at an area thereof onto which the apparatus is engaged by the self-gripping action thereof in a pried-open status of greater diameter than said default diameter.

* * * * *